US009963882B2

(12) United States Patent
Daneau

(10) Patent No.: US 9,963,882 B2
(45) Date of Patent: May 8, 2018

(54) MANUALLY OPERATED SNOW REMOVAL DEVICE FOR ROOFS AND OTHER GENERALLY FLAT AREAS

(71) Applicant: James Daneau, Chester, NH (US)

(72) Inventor: James Daneau, Chester, NH (US)

(73) Assignee: SNO DOLLY, INC., Chester, NH (US)

( * ) Notice: Subject to any disclaimer, the term of this patent is extended or adjusted under 35 U.S.C. 154(b) by 0 days. days.

(21) Appl. No.: 15/247,508

(22) Filed: Aug. 25, 2016

(65) Prior Publication Data

US 2017/0089073 A1 Mar. 30, 2017

Related U.S. Application Data

(60) Provisional application No. 62/211,166, filed on Aug. 28, 2015.

(51) Int. Cl.

| | |
|---|---|
| ***E04D 13/10*** | (2006.01) |
| ***E01H 5/02*** | (2006.01) |
| ***E01H 5/04*** | (2006.01) |
| ***E01H 5/06*** | (2006.01) |

(52) U.S. Cl.

CPC ..... *E04D 13/106* (2013.01); *E01H 5/02* (2013.01); *E01H 5/04* (2013.01); *E01H 5/06* (2013.01)

(58) Field of Classification Search

CPC ..... E04D 13/106; E01H 5/02; E01H 5/04; E01H 5/06; E01H 5/045

See application file for complete search history.

(56) References Cited

U.S. PATENT DOCUMENTS 1,722,293 A * 7/1929 Hoffman ..... A01B 35/26 172/357
1,933,625 A * 11/1933 Hovland ..... A01B 1/12 172/372
2,710,465 A * 6/1955 Timerson ..... E01H 5/067 172/371
3,091,790 A * 6/1963 Schroeder ..... E04D 13/106 15/105
3,218,738 A * 11/1965 Bowerman ..... E04D 13/106 294/54.5
3,483,643 A * 12/1969 Wenzel ..... E01H 5/02 15/236.01
3,915,240 A * 10/1975 Pittman ..... A01B 1/10 172/371
3,998,486 A * 12/1976 Mittelstadt ..... E04D 13/106 37/284
4,089,127 A * 5/1978 Maijala ..... E04D 13/106 15/236.01
4,185,403 A * 1/1980 Hardgrove ..... E01H 5/02 15/257.1
4,249,767 A * 2/1981 Andreasen ..... E04D 13/106 294/54.5

(Continued)

*Primary Examiner* — Jamie L McGowan

(57) ABSTRACT

A manually operated snow removal device designed for generally flat surfaces such as roofs includes a box-shaped device having a scalloped or undulating front and rear edge to cut through the snow; a leading bottom edge which protrudes from the box-shaped device to prevent the device from falling off roofs and a load belt made of a length of HPDE material for transporting the snow loaded on the load belt. A telescopic pole attaches to the device and allows the operator to remove approximately 10 square feet of snow and subsequently moved that snow to a desired location on the roof. The operator than moves the device such that the load belt folds over the edge of the roof dumping the snow in a desired location.

4 Claims, 9 Drawing Sheets

(56) References Cited

U.S. PATENT DOCUMENTS 4,386,474 A * 6/1983 Mechavich ..... E04D 13/106 294/54.5
5,083,388 A * 1/1992 Cooley ..... E04D 13/106 37/268
5,465,510 A * 11/1995 Goodnough ..... E04D 13/106 294/54.5
5,570,524 A * 11/1996 Groat ..... E04D 13/106 37/268
5,813,152 A * 9/1998 Weight ..... E01H 5/08 37/249
5,943,796 A * 8/1999 Hedstrom ..... E04D 13/0765 294/54.5
5,956,873 A * 9/1999 Hess ..... E01H 5/02 294/54.5
6,092,315 A * 7/2000 Katauskas ..... E04D 13/106 15/236.01
6,158,791 A * 12/2000 Drew ..... E04D 15/006 294/54.5
6,189,942 B1 * 2/2001 Peterson ..... E04D 13/106 294/54.5
6,202,329 B1 * 3/2001 Supplee ..... E04D 13/106 294/54.5
6,578,890 B1 * 6/2003 Gilmore ..... E04D 13/106 294/53.5
8,505,711 B2 * 8/2013 Geraets ..... A01D 87/10 198/300
2004/0055184 A1 * 3/2004 Peterson ..... E04D 13/106 37/230
2008/0086919 A1 * 4/2008 Chartier, Jr. ..... E04D 13/106 37/197
2009/0293320 A1 * 12/2009 Cummings ..... E01H 5/04 37/241
2013/0075118 A1 * 3/2013 Pellenc ..... A01B 1/08 172/41
2013/0167411 A1 * 7/2013 Bjorthun ..... E01H 5/02 37/197
2014/0283417 A1 * 9/2014 Annen ..... E04D 13/106 37/197

* cited by examiner

MANUALLY OPERATED SNOW REMOVAL DEVICE FOR ROOFS AND OTHER GENERALLY FLAT AREAS

CROSS-REFERENCE TO RELATED APPLICATIONS

This application claims priority from U.S. Provisional Patent Application No. 62/211,166 entitled "Manually Operated Snow Removal Device For Roofs And Other Generally Flat Areas" filed on Aug. 28, 2015 which is incorporated fully herein by reference.

TECHNICAL FIELD

The present invention relates to manually operated snow removal devices and more particularly, relates to a manually operated snow removal device which allows the operator to load and transport large amounts of snow from generally flat areas to an edge of the area being cleaned of snow for dumping.

BACKGROUND INFORMATION

Snowfall is an annual occurrence in much of the United States and the rest of the world. Although accumulated snow is more readily disposed of on roadways, driveways, walks and the like, the unwanted accumulation of snow on commercial, industrial and municipal flat roof buildings and other flat structures often becomes a serious problem in northern climates. The weight of accumulated snow and stress on building roofs can and often does result in costly damage to structural roof members and precipitates the need for costly roof repairs. If left unattended, accumulated snowfall on building roofs can and often does lead to roof collapse along with an obvious significant safety risk. In addition, snow accumulation on commercial, industrial and municipal flat roofs that frequently have major public activity around the perimeter of such buildings is dangerous because of the risk of falling snow and ice.

Removing accumulated snow on a large flat roof buildings is labor-intensive, time consuming, costly and dangerous. Removing snow from the center of a large flat roof is especially difficult and challenging given the distance that the snow must be transported to get it off the roof.

Various attempts or removing snow accumulation from flat building roofs have been tried. One approach involves heating hoses around the roof surface and moving them around periodically in order to melt the snow in the hopes of draining the melted snow down roof drains. Although sometimes effective, this process is costly and requires much mechanical equipment and physical effort and in some instances can create more complications from mechanical failure, the clogging of drains, or the freezing of water on the roof like a lake.

Another approach involves the use of snow shovels for shoveling, pushing, carrying and throwing the snow off the roof. This approach requires many shovels and many users to exert tremendous effort, time and energy to remove the snow and throw it or push it from the roof edge. This is dangerous to the worker on the roof in terms of falling or sliding off the roof as well as dangerous to those passersby underneath who might be hit from falling snow.

A still further approach involves the use of a snow blower to blow the snow off the roof. A snow blower includes a gas or electric motor to gather and throw the snow off the roof. A drawback exists with this method also in that snow blowers are typically heavy and difficult to get to the roof or most importantly, the snow blower only throws the snow a maximum distance which is a challenge when trying to remove snow from the middle of a large roof.

Accordingly, what is needed is a hand powered safe, easy to operate snow removal device which is less time-consuming to use to clear a large area and requires less physical energy to remove significant quantities of snow from generally flat roof and other surfaces.

SUMMARY OF THE INVENTION

The invention features a manually operated snow removal device, for removing snow from a generally flat surface. The manually operated snow removal device comprises a generally box-shaped device having a top portion, a bottom portion and left and right side portions. The generally box-shaped device includes a leading edge and a trailing edge. At least the leading edge of one or both of the left and right side portions includes a scalloped or undulating shape configured to cut through snow.

A no drop leading edge portion is attached to the bottom portion and protrudes beyond the left and right side portions on the leading edge of the generally box-shaped device. The device further includes a flexible, plastic load belt, coupled to a trailing edge of the bottom portion of the generally box-shaped device. The load belt is configured to move or transport the snow by the manually operated snow removal device once loaded onto the load belt.

In one embodiment, the no drop leading edge includes a plurality of roof guards, configured for spacing the generally box-shaped device away from a surface of a roof being cleaned of snow. In another embodiment, the device may further include a snow lock tab, coupled to the top portion of the box shaped device and extending beyond the trailing edge of the box shaped device. The snow lock tab preferably protrudes downward at an angle of between 15° and 40° from the top portion of the box shaped device.

In yet a further embodiment, the top portion of the device may further include an upwardly turned leading edge portion protruding upward from the top portion at between a 50° and 75° angle.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
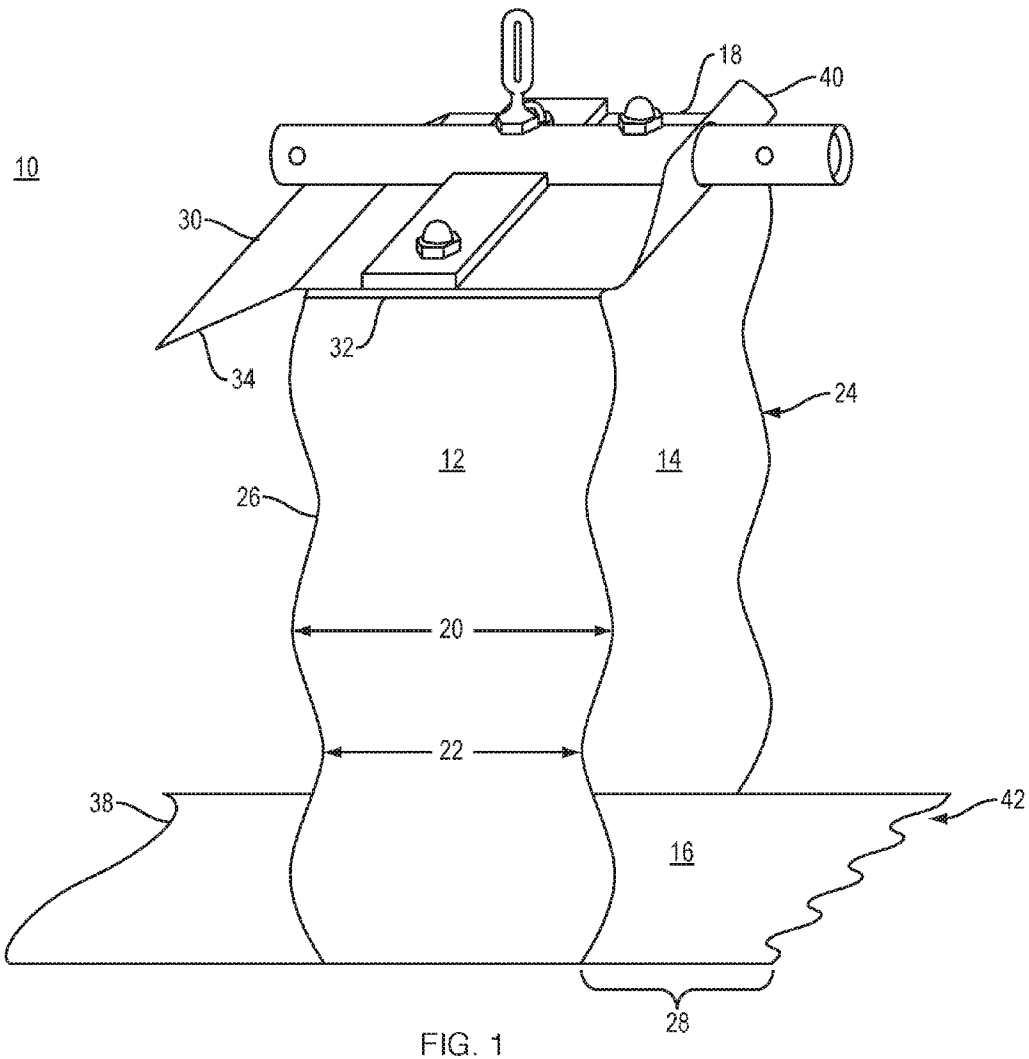
FIG. 1 is a perspective view of the manually operated snow removal device according to the present invention.

The present invention features a manually operated snow removal device 10, FIG. 1, including side portions 12 and 14, bottom portion 16 and top portion 18. The manually operated snow removal device 10 is preferably made from a single piece of high grade aluminum of not less than 0.080 inches thick to provide for the required strength and structural integrity. In the first preferred embodiment, the body is cut from a single piece of high grade aluminum 52 inches long and 7 inches wide at the widest point 20 and 4 inches wide at the narrowest point 22, giving the front 24 and rear 26 edges of body the wavy "scalloped" shape necessary which serves to cut through hard and/or crusted snow.

By forming 3 90° bends in the single piece of material, a box-shaped body portion measuring 16 inches wide by 10 inches tall may be formed. The 2 ends are brought together and welded, while the body may be drilled for parts and hardware as will be explained below. Although the present invention will be described in a first embodiment in terms of predetermined measurements, this is not a limitation of the present invention as the body or box portion may be made wider and/or taller. In addition, the side portions 12 and 14 may be made adjustable instead of a fixed size such that they can be made taller if the snow conditions will allow for dealing with a greater "depth" of snow.

The bottom portion 16 is formed as part of and integral with the body portion and serves as a no-drop leading edge. A portion of the no-drop leading edge (that portion indicated generally by section 28) protrudes approximately 1½ inches to 4 or 5 inches from the body portion and allows the manually operated snow removal device 10 of the invention to be inserted into snow along the edge of the roof while providing a support lip for the device to rest on the roof without fear that it will fall off the roof.

Figure 3:
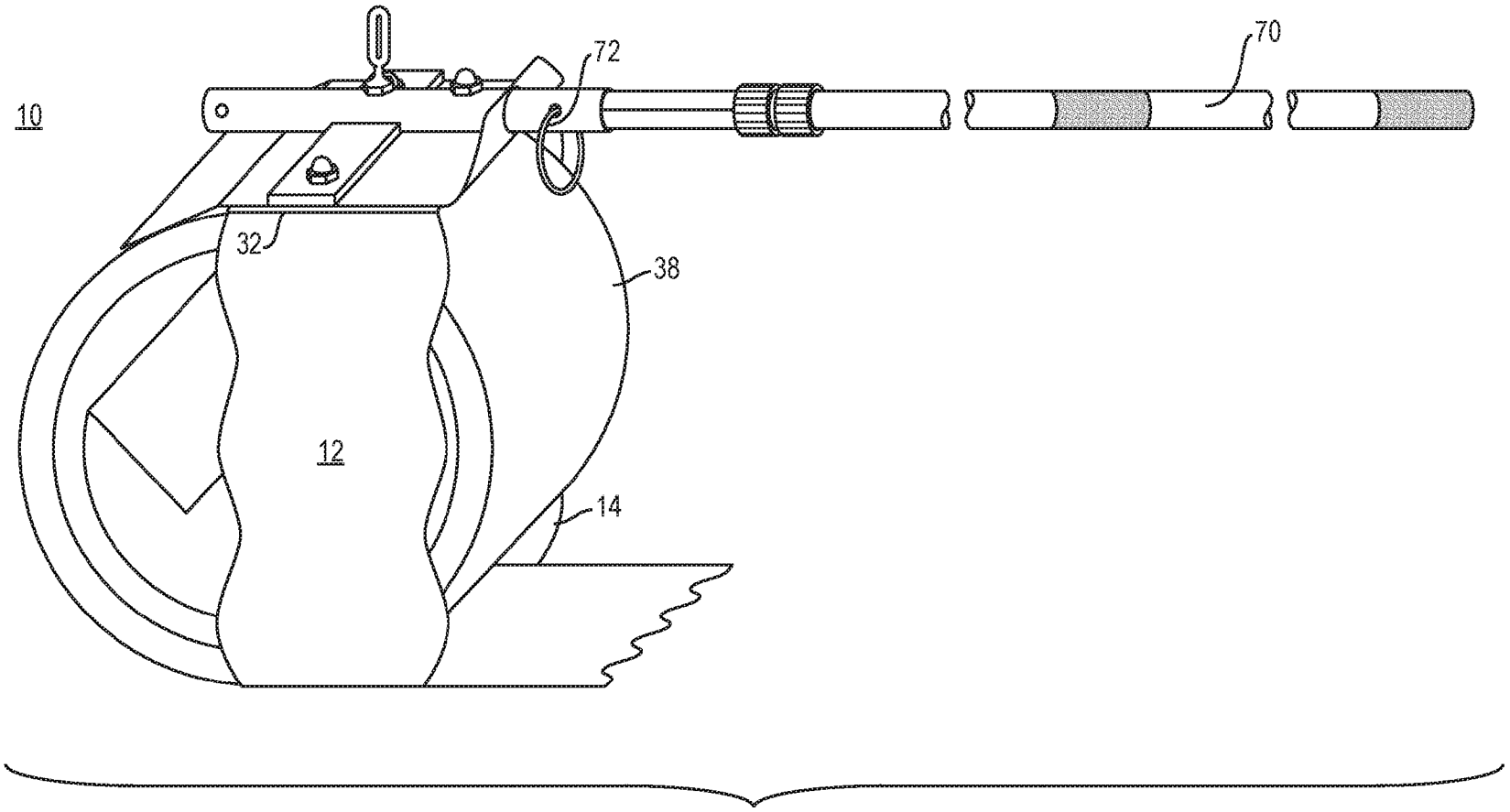
FIG. 3 is a perspective side view of the manually operated snow removal device according to the present invention prior to use.
Figure 4:
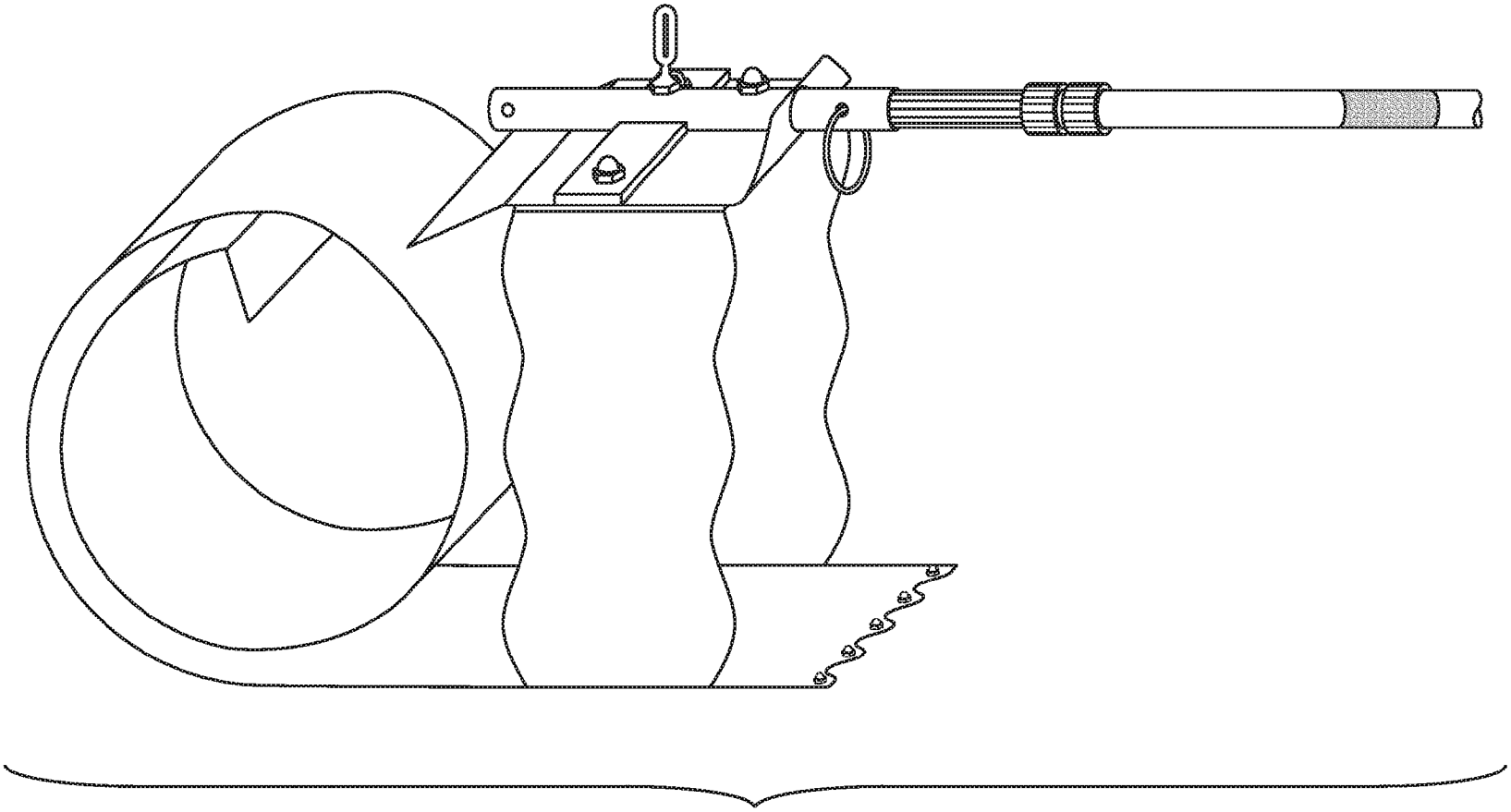
FIG. 4 is a side perspective view of the manually operated snow removal device of the present invention with the load belt partially deployed.
Figure 5:
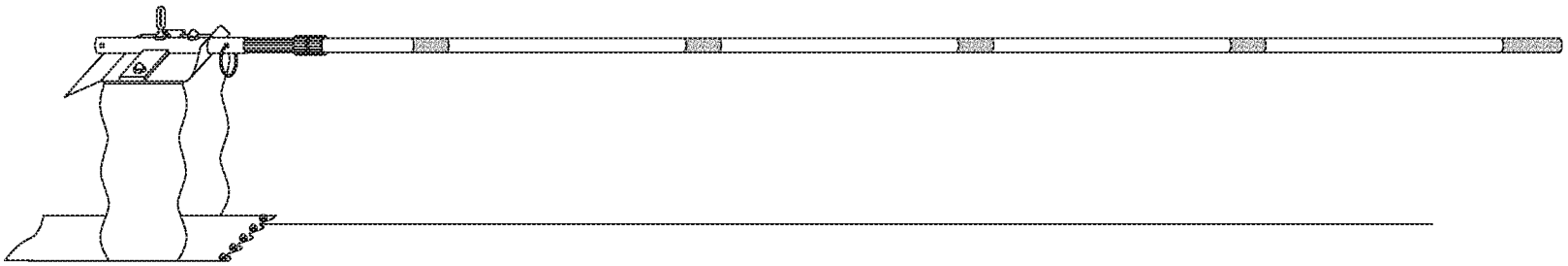
FIG. 5 is a side perspective view of the manually operated snow removal device of the present invention ready to be deployed and used.

The device 10 according to the present invention also includes a snow lock tab 30 which, in one embodiment, may be made from 0.040 inch-thick HDPE plastic measuring approximately 3 inches wide by 16¼ inches long and is attached to and extends from the upper rear edge 32 of the device 10. The snow lock tab 30 includes a 1½ inch downward protruding flap portion 34 angled downward at approximately 20°. The snow lock tab 30 serves to hold the snow within the body (sides, bottom and top) of the device 10 and the loading belt 38 when pushing the device 10 back for transport and unloading, as will be explained in greater detail below. The load belt 30 is attached to the rear portion of the device 10 and is a 15¾ inch wide by 96 inch long semi-rigid HDPE plastic sheet that is attached using bolts or rivets through the load belt 30 and the bottom portion of the device 10. The load belt 30 is shaped and naturally formed into a retractable coil shape which will self-store inside the sides 12 and 14 of the device 10 when not in use, as shown in FIG. 3. The load belt is configured to move or transport the snow by the manually operated snow removal device once the snow is loaded onto the load belt. The load belt 38 preferably includes an upward angled end portion 42, FIG. 8, which has a 70°, 4 inch upward bend, which serves to hold the snow on the load belt 38 when transporting the snow to the edge of the roof for discharge, thereby preventing unintentional discharge of snow during loading and transport. The coiled retractable load belt 38 will flatten and roll out as snow enters the body of the device 10 from the front end 42.

The device 10 also includes a top support plate 40 including a forward oriented angled portion pointing up at a 70° angle and spanning the distance between the vertical sides 12 and 14. This portion serves to provide additional strength and stability to the handle (via a handle rod which extends through a hole in this upward shaped portion); regulates the bite depth of the manually operated device 10; prevents overloading of the device and allows smooth frictionless operation by preventing snow buildup in front of the handle.

Figure 2:
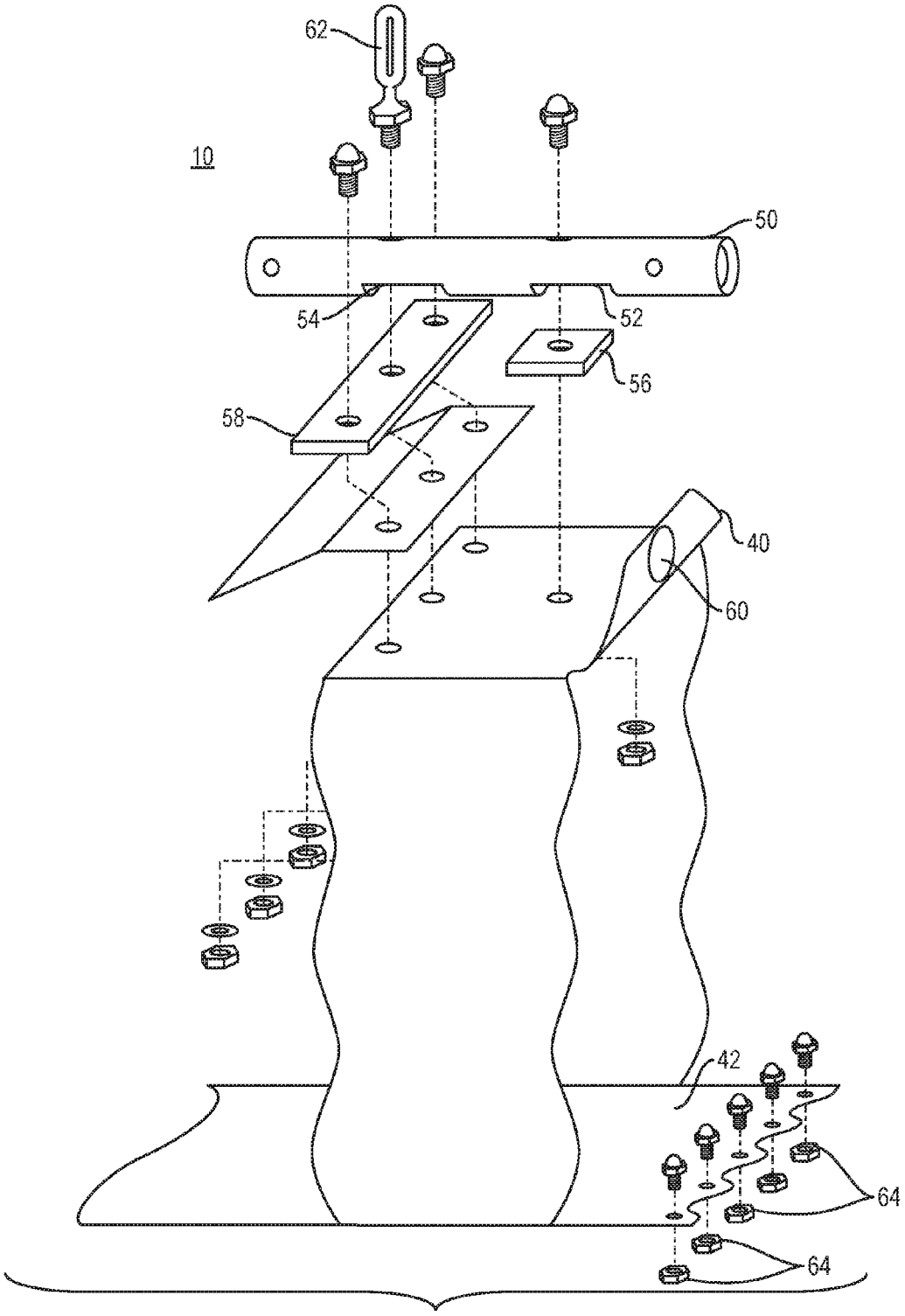
FIG. 2 is a perspective exploded view of the manually operated snow removal device of the invention.

The device 10 according to the present invention also includes a handle support rod portion 50, FIG. 2, which is preferably made from approximately 1³⁄₁₆ inch thick walled aluminum pipe 8½ inches long having two 1 inch wide by ¼ inch deep flat notches 52 and 54 on the bottom of the handle rod 54 to provide proper alignment and placement on top of support plate's 56 and 58 respectively. The handle rod 50 is inserted through the hole 60 in top plate 40 and then bolted to the top of the body frame using appropriately sized bolts or nuts. I-bolt 62 may additionally be provided for hanging the device 10 for storage during the off-season. The no-drop leading edge 42 may also include a plurality of roof guard elements 64 which serve to keep the bottom of the device 10 spaced up and away from the surface of the roof to prevent damaging the roof and also to maintain a thin layer of snow to assist in moving the device around the roof once it is fully loaded with snow. The roof guard elements 64 may consist of a number of rubber or plastic coated stainless steel acorn nuts or any other kind of "feet" or elements which might serve to keep the leading edge 42 and the entire device 10 generally spaced up and away from the roof surface by a small amount.

As shown in FIG. 3, the device 10 will naturally retain a stored state ready for use with the loading belt 38 coiled within the side portions 12 and 14 of the device 10. In addition, a telescopic handle 70 is provided. The handle is preferably made from a nonconductive fiber glass tubing in order to prevent electrical shock from buried or non-buried electrical hazards. The handle 70 is attached to the handle rod 50 utilizing one or more bolts or pins 72. The handle 70 may be adjustable any length from between approximately 8 feet up to 16 feet as necessary for easy and safe operation. In addition, pin 72 may also provide an eyebolt to which a tether may be secured between the operator and the device 10 to prevent the device from falling off a roof.

Figure 6:
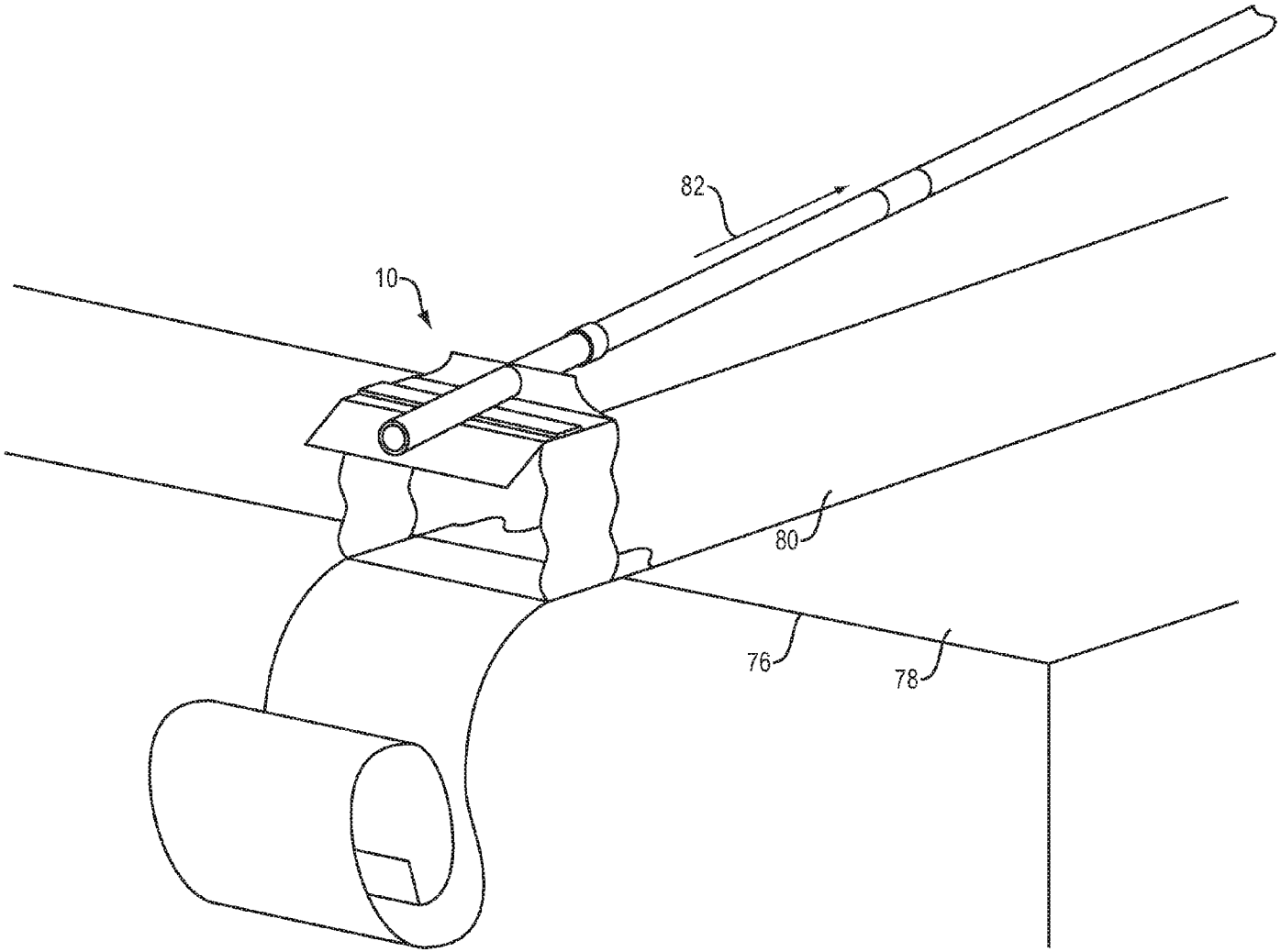
FIG. 6 is a side perspective view of the manually operated snow removal device of the present invention being inserted into snow on a flat surface.
Figure 7:
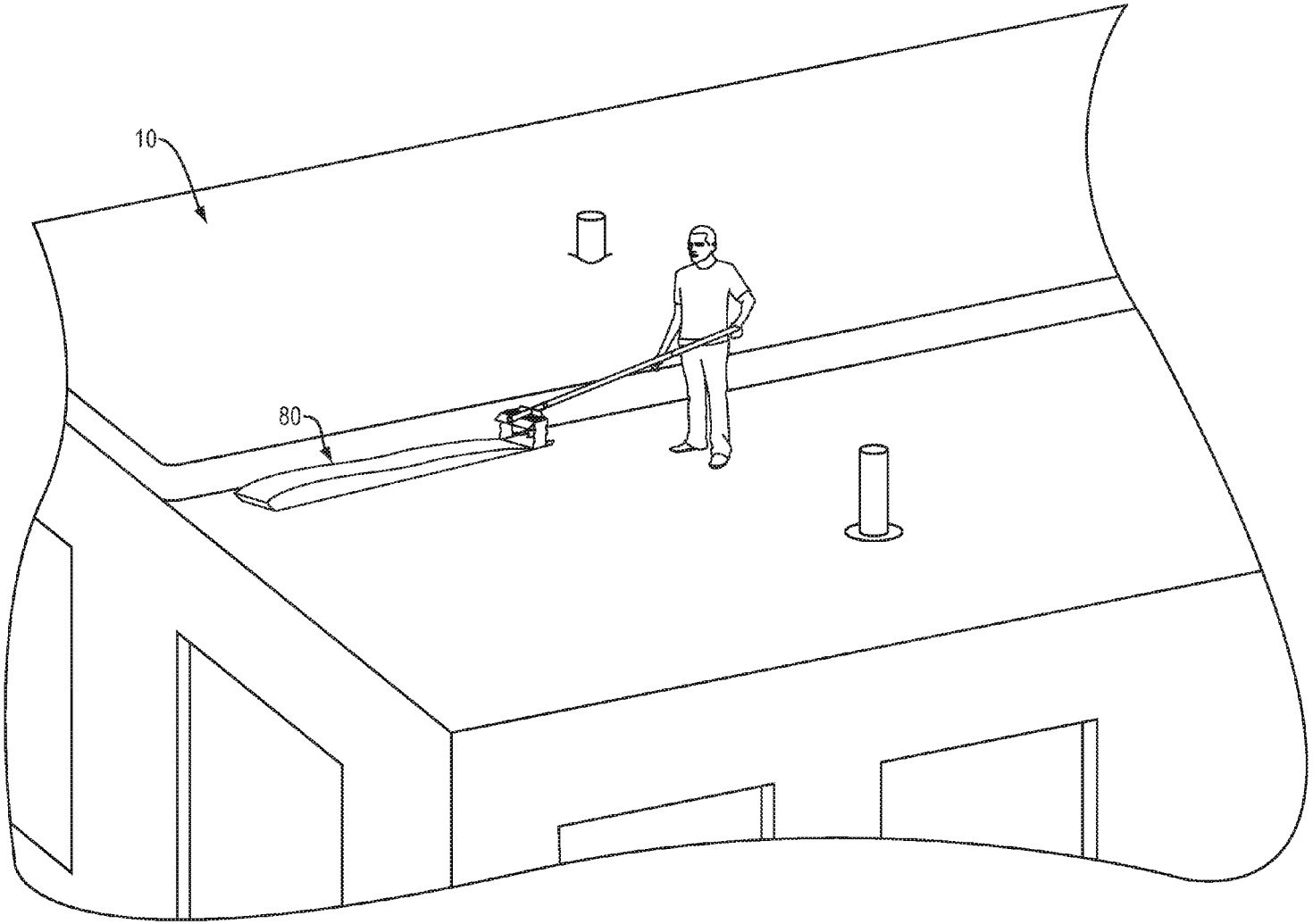
FIG. 7 is a perspective view of a user having fully loaded the load belt with snow in the process of moving or transporting the snow to a roof edge.
Figure 8:
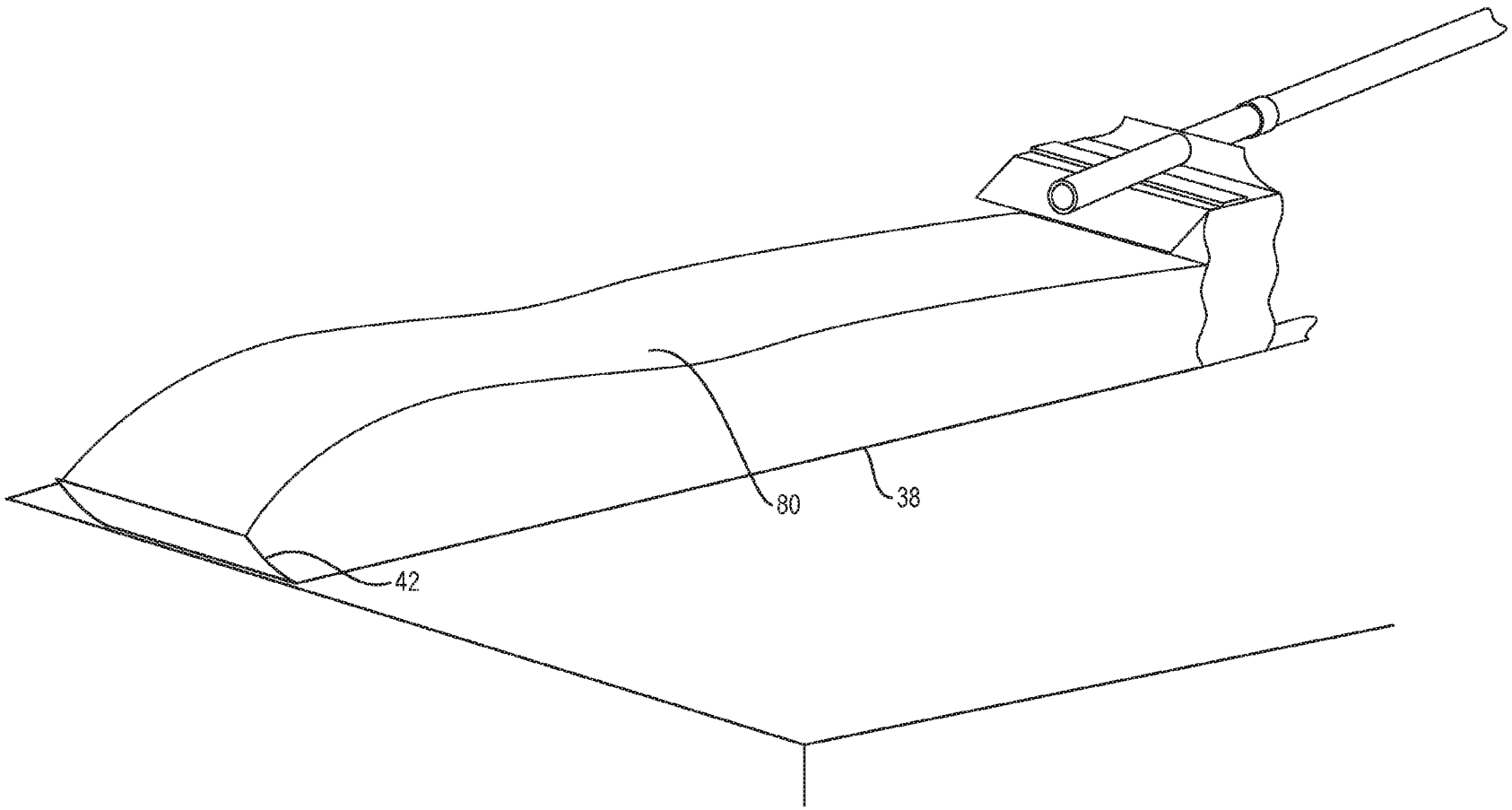
FIG. 8 is a close-up side perspective view of the fully loaded manually operated snow removal device of FIG. 7.
Figure 9:
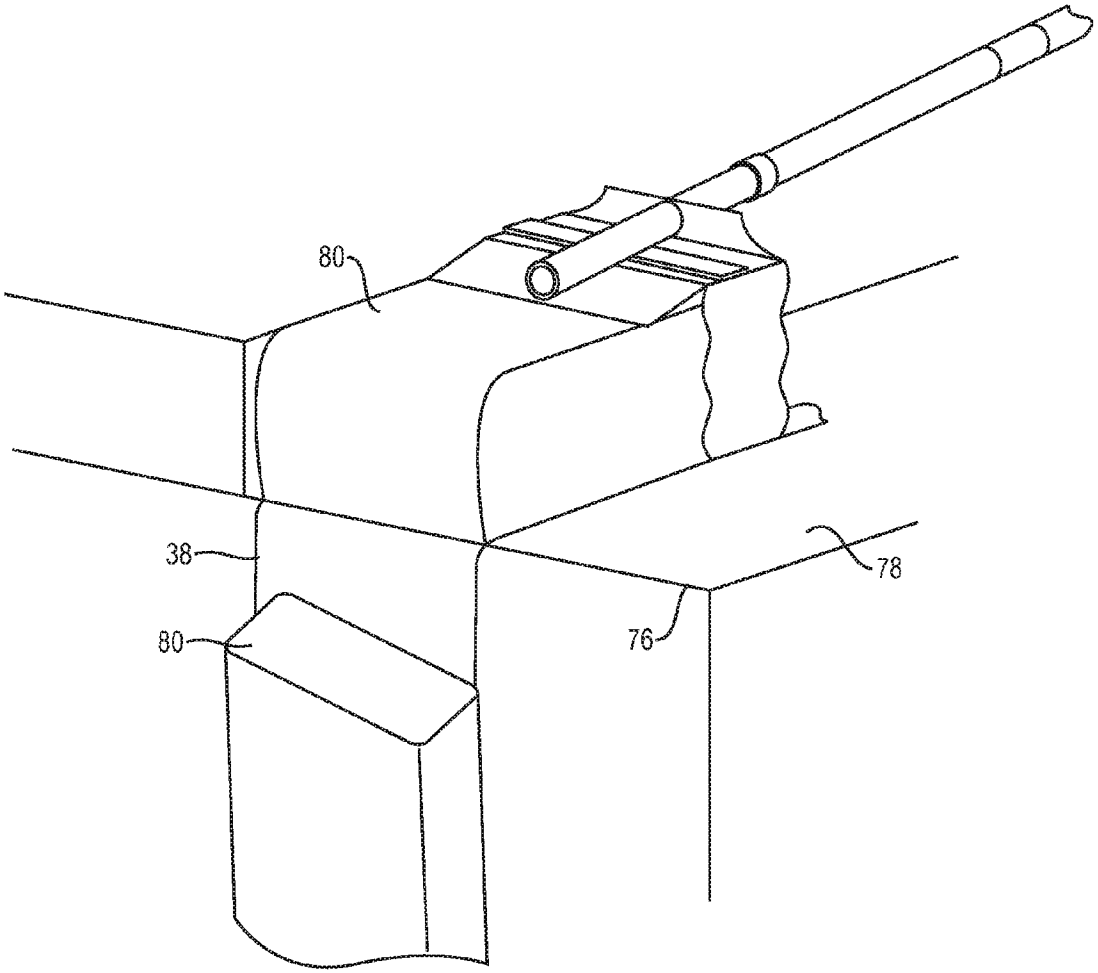
FIG. 9 is a side perspective view of the snow loaded manually operated snow removal device wherein the snow is being discharged from the edge of a flat roof.

In operation, the device 10 is brought to the edge 76, FIG. 6, of a roof 78 and pulled through the snow 80 in the direction of arrow 82 until the load belt 38 is loaded with snow 80, FIGS. 7 and 8. The operator than moves the entire device 10 including the snow 80 contained on the load belt towards the edge of the roof 76, FIG. 9 and as the load belt 38 drapes or folds over the edge 76 of the roof 78, the snow 80 falls off the load belt 38 onto the ground below. In this manner, snow loaded onto the load belt 38 can be transported wherever on the roof the user desires and thereby the user can control exactly where the snow is dumped from the roof irrespective of where it was removed from. The snow can be dumped in a convenient area on the ground that allows for safe dumping and removal of the snow.

Accordingly, the present invention provides a manually operated snow removal, carrying and dumping device which allows an operator to easily, quickly and a large volume of snow (approximately 10 ft.$^2$) and hundreds of pounds of weight to be quickly and easily removed and transported any distance across the roof to a safe and favorable drop area for unloading over the roof edge. Using repeated back and forth movements, an operator this capable of clearing and area measuring 1000 ft.$^2$ of snow per hour with minimal effort whether the snow was light, fluffy, packed, drifted, heavy, wet or even ice encrusted.

Modifications and substitutions by one of ordinary skill in the art are considered to be within the scope of the present invention, which is not to be limited except by the allowed claims and their legal equivalents.

The invention claimed is:

1. A manually operated snow removal device, for removing snow from a generally flat surface, said manually operated snow removal device comprising:

a generally box-shaped device having a top portion, a bottom portion and left and right side portions, said generally box-shaped device including a leading edge and a trailing edge, said generally box-shaped device configured for being pulled through snow disposed on said generally flat surface in a direction from said leading edge to said trailing edge;

wherein at least the leading edge of said left and right side portions include a scalloped or undulating shape configured to cut through snow as said generally box-shaped device is pulled through snow disposed on said generally flat surface in said direction from said leading edge to said trailing edge;

planar, no drop leading edge portion, attached to and co-planar with said bottom portion of said generally box-shaped device and protruding forward beyond said left and right side portions on said leading edge of said generally box-shaped device;

a top support plate, said top support plate including an upwardly turned leading edge portion pointing upward from a plane of said top portion and spanning a distance between said left and right side portions proximate said leading edge of said generally box-shaped device, said upwardly turned leading edge portion of said top support plate including a hole configured to receive a device handle rod extending through said hole and coupled to said top support plate, said top support plate configured to provide strength and stability to a handle extending through said device handle rod which extends through said hole in said upwardly turned leading edge portion of said top support plate, said top support plate also including a snow lock tab portion, said snow lock tab portion of said top portion extending beyond said trailing edge of said box shaped device, wherein said snow lack tab portion protrudes downward from a plane of said top portion of said box shaped device and spans a distance between said left and right side portions proximate said trailing edge of said generally box-shaped device;

said handle, removably secured to said device handle rod coupled to said top support plate, said device handle extending in a direction of said leading edge of said box-shaped device; and said device further including a flexible, plastic load belt, coupled to a trailing edge of said bottom portion of said generally box-shaped device, and configured for facilitating transport of snow on said load belt.

2. The device of claim 1, wherein said no drop leading edge includes a plurality of roof guards, configured for spacing said generally box-shaped device away from a surface of a roof being cleaned of snow.

3. The device of claim 1, wherein said snow lock tab portion of said top portion protrudes downward from said plane of said top portion at an angle of between 15° and 40°.

4. The device of claim 1, wherein said upwardly turned leading edge portion protrudes upward from said plane of said top portion at an angle of between a 50° and 75°.

* * * * *